US012044241B2

(12) United States Patent
Sakaguchi

(10) Patent No.: US 12,044,241 B2
(45) Date of Patent: Jul. 23, 2024

(54) VACUUM PUMP AND VACUUM PUMP COMPONENT

(71) Applicant: Edwards Japan Limited, Chiba (JP)

(72) Inventor: Yoshiyuki Sakaguchi, Chiba (JP)

(73) Assignee: Edwards Japan Limited, Chiba (JP)

( * ) Notice: Subject to any disclaimer, the term of this patent is extended or adjusted under 35 U.S.C. 154(b) by 443 days.

(21) Appl. No.: 17/286,968

(22) PCT Filed: Oct. 24, 2019

(86) PCT No.: PCT/JP2019/041794
§ 371 (c)(1),
(2) Date: Apr. 20, 2021

(87) PCT Pub. No.: WO2020/090632
PCT Pub. Date: May 7, 2020

(65) Prior Publication Data

US 2021/0388840 A1 Dec. 16, 2021

(30) Foreign Application Priority Data

Oct. 31, 2018 (JP) ..... 2018-205003

(51) Int. Cl.
*F04D 19/04* (2006.01)
*F04D 29/54* (2006.01)
(Continued)

(52) U.S. Cl.
CPC ..... *F04D 19/042* (2013.01); *F04D 29/541* (2013.01); *F04D 29/5853* (2013.01); *F04D 29/701* (2013.01)

(58) Field of Classification Search
CPC .... F04D 19/04; F04D 19/042; F04D 29/5853; F04D 29/5826; F04D 23/16
See application file for complete search history.

(56) References Cited

U.S. PATENT DOCUMENTS

2008/0253903 A1 10/2008 Hablanian
2013/0309076 A1* 11/2013 Nonaka ..... F04D 29/02 415/200
2015/0086328 A1 3/2015 Tsutsui

FOREIGN PATENT DOCUMENTS

EP 2910791 A1 8/2015
EP 3611381 A1 * 2/2020 ..... F04D 19/042
(Continued)

OTHER PUBLICATIONS

European Communication dated Jun. 27, 2022 and Search Report dated Jun. 16, 2022 for corresponding European application Serial No. 19879702.9, 7 pages.
(Continued)

*Primary Examiner* — Philip E Stimpert
(74) *Attorney, Agent, or Firm* — Theodore M. Magee; Westman, Champlin & Koehler, P.A.

(57) ABSTRACT

To provide a vacuum pump that is capable of efficiently cooling gas and requires less maintenance. The vacuum pump includes: a main body casing having an inlet portion and an outlet portion for gas; a turbomolecular pump mechanism portion in which a stator blade and a rotor blade are formed; a thread groove pump mechanism portion provided at a downstream side of the turbomolecular pump mechanism portion; a cooling trap portion that cools the gas led out from the turbomolecular pump mechanism portion and causes the gas to flow out to a side of the thread groove pump mechanism portion; and a partition wall that guides the gas led out from the turbomolecular pump mechanism portion to the cooling trap portion.

12 Claims, 10 Drawing Sheets

(51) Int. Cl.
*F04D 29/58* (2006.01)
*F04D 29/70* (2006.01)

(56) References Cited

FOREIGN PATENT DOCUMENTS

| | | | |
|---|---|---|---|
| JP | H03199699 | A | 8/1991 |
| JP | H0612794 | U | 2/1994 |
| JP | 2002-242877 | A | 8/2002 |
| JP | 2003254284 | A | 9/2003 |
| JP | 2004076708 | A | 3/2004 |
| JP | 2006144590 | A | 6/2006 |
| JP | 2015190404 | A | 11/2015 |
| WO | 2015122215 | A1 | 8/2015 |

OTHER PUBLICATIONS

PCT International Search Report dated Dec. 24, 2019 for corresponding PCT application Serial No. PCT/JP2019/041794, 4 pages.
PCT International Written Opinion dated Dec. 24, 2019 for corresponding PCT application Serial No. PCT/JP2019/041794, 6 pages.

* cited by examiner

VACUUM PUMP AND VACUUM PUMP COMPONENT

CROSS-REFERENCE OF RELATED APPLICATION

This application is a Section 371 National Stage Application of International Application No. PCT/JP2019/041794, filed Oct. 24, 2019, which is incorporated by reference in its entirety and published as WO 2020/090632. A1 on May 7, 2020 and which claims priority of Japanese Application No. 2018-205003, filed Oct. 31, 2018.

BACKGROUND OF THE INVENTION

The present invention relates to a vacuum pump such as a turbomolecular pump, and a component thereof.

Turbomolecular pumps have generally been known as a type of vacuum pump. In a turbomolecular pump, rotor blades are rotated by energization of a motor in a pump main body, and gas molecules of gas sucked into the pump main body are ejected to exhaust the gas. Also, some of these turbomolecular pumps are equipped with a cooling trap portion (also referred to as a "cooling portion" or "trap portion"), wherein the cooling trap portion actively sublimates (solidifies, in this case) the sedimentary components contained in the gas.

As this type of turbomolecular pump, there exist a turbomolecular pump that has the cooling trap portion disposed in the middle of an exhaust flow path (Japanese Patent Application Laid-Open No. 2003-254284), a turbomolecular pump that has the cooling trap portion disposed outside an exhaust flow path to separate some of the gas (Japanese Patent No. 4211320, Japanese Patent No. 4916655), and the like. In Japanese Patent No, 4211320 and Japanese Patent No. 4916655, the gas flowing through the exhaust flow path is indicated by the alphabet G, and the separated gas flowing into the cooling trap portion is indicated by the alphabet g.

The discussion above is merely provided for general background information and is not intended to be used as an aid in determining the scope of the claimed subject matter. The claimed subject matter is not limited to implementations that solve any or all disadvantages noted in the background.

SUMMARY OF THE INVENTION

Incidentally, of these various turbomolecular pumps described above, in the one disclosed in Japanese Patent Application Laid-Open No. 2003-254284, the cooing trap portion is installed in the middle of the exhaust flow path and faces the exhaust flow path. Therefore, compared to the turbomolecular pumps disclosed in Japanese Patent No. 4211320 and Japanese Patent No. 4916655, the turbomolecular pump disclosed in Japanese Patent Application Laid-Open No. 2003-254284 can bring a larger amount of gas into contact with the cooling trap portion, thereby sublimating the sedimentary components contained in the gas more efficiently.

However, since deposits are precipitated in the exhaust flow path, the exhaust flow path gradually becomes clogged as the amount of deposits increases, deteriorating the exhaust performance. Moreover, it is difficult to remove the deposits while keeping the cooling trap portion in a casing. In order to remove the deposits, and restore the exhaust flow path (flow path area) to the original size thereof, the cooling trap portion needs to be detached, and overhauling of the cooling trap portion needs to be performed as maintenance.

On the other hand, as in the turbomolecular pumps described in Japanese Patent No. 4211320 and Japanese Patent No. 4916655 in which some of the gas is caused to flow from the exhaust flow path toward the cooling trap portion, the cooling trap portion can be separated from the exhaust flow path, preventing the formation of deposits in the exhaust flow path. However, simply communicating the flow path for guiding some of the gas of the exhaust flow path (the gas flow path indicated by the alphabet g) with the exhaust flow path to spatially connect these flow paths, does not always lead to the expected gas separation. Therefore, in the turbomolecular pumps disclosed in Japanese Patent No. 4211320 and Japanese Patent No. 4916655, it is difficult to effectively utilize the cooling trap portion.

In particular, the mean free path of the molecules of the gas compressed in the stage prior to the cooling trap portion is considered to be approximately 0.5 mm, and theoretically it is difficult to move the molecules of the gas to a position away from the exhaust flow path. Therefore, in the turbomolecular pumps disclosed in Japanese Patent No. 4211320 and Japanese Patent No, 4916655 that divide the gas, it is difficult to cause the cooling trap portion to efficiently sublimate the sedimentary components of the gas.

An object of the present invention is to provide a vacuum pump that is capable of efficiently cooling gas and requires less maintenance, and a component of the vacuum pump.

(1) In order to achieve the foregoing object, the present invention provides a vacuum pump, comprising:

- a casing having an inlet portion and an outlet portion for gas;
- a pump mechanism portion in which stator blades and rotor blades are formed;
- a thread groove exhaust mechanism portion provided at a downstream side of the pump mechanism portion;
- a cooling trap portion that cools the gas led out from the pump mechanism portion and causes the gas to flow out to a side of the thread groove exhaust mechanism portion; and a partition wall portion that guides the gas led out from the pump mechanism portion to the cooling trap portion.

(2) In order to achieve the foregoing object, another invention provides the vacuum pump described in (1), wherein the partition wall portion is a disc-shaped member installed in the casing.

(3) In order to achieve the foregoing object, another invention provides the vacuum pump described in (2), wherein the partition wall portion is provided integrally with the rotor blades.

(4) In order to achieve the foregoing object, another invention provides the vacuum pump described in (1), wherein the thread groove exhaust mechanism portion is provided downstream of the partition wall portion.

(5) In order to achieve the foregoing object, another invention provides the vacuum pump described in (1), wherein the thread groove exhaust mechanism portion is provided upstream of the partition wall portion.

(6) In order to achieve the foregoing object, another invention provides the vacuum pump described in (1), wherein the cooling trap portion has a trap temperature falling below at least one sublimation temperature of a gas component.

(7) In order to achieve the foregoing object, another invention provides the vacuum pump described in (1), wherein the cooling trap portion has an attachment portion configuring a heat insulating structure.

(8) In order to achieve the foregoing object, another invention provides the vacuum pump described in (1), wherein further comprising a deposit removal function that removes deposits in the cooling trap portion.

(9) In order to achieve the foregoing object, another invention provides the vacuum pump described in (1), wherein the cooling trap portion is provided with second inflow and outflow port different from first inflow and outflow port which is an inflow and outflow port for the gas.

(10) In order to achieve the foregoing object, another invention provides the vacuum pump described in (1), wherein the cooling trap portion has a non-adhesive coating applied to at least a part of an inner surface of the cooling trap portion.

(11) In order to achieve the foregoing object, another invention provides the vacuum pump described in (1), wherein the casing is configured by combining the cooling trap portion and a predetermined casing member, of which only the cooling trap portion is detachable.

(12) In order to achieve the foregoing object, another invention provides a vacuum pump component, comprising: an upstream-side gas guiding surface for guiding gas in a centrifugal direction in a casing of a vacuum pump; and a downstream-side gas guiding surface for guiding the gas in a centripetal direction.

The present invention can provide a vacuum pump that is capable of efficiently cooling gas and requires less maintenance, and a component of the vacuum pump.

The Summary is provided to introduce a selection of concepts in a simplified form that are further described in the Detail Description. This summary is not intended to identify key features or essential features of the claimed subject matter, nor is it intended to be used as an aid in determining the scope of the claimed subject matter.

DESCRIPTION OF THE PREFERRED EMBODIMENTS

A vacuum pump according to each embodiment of the present invention is now described hereinafter with reference to the drawings.

Figure 1:
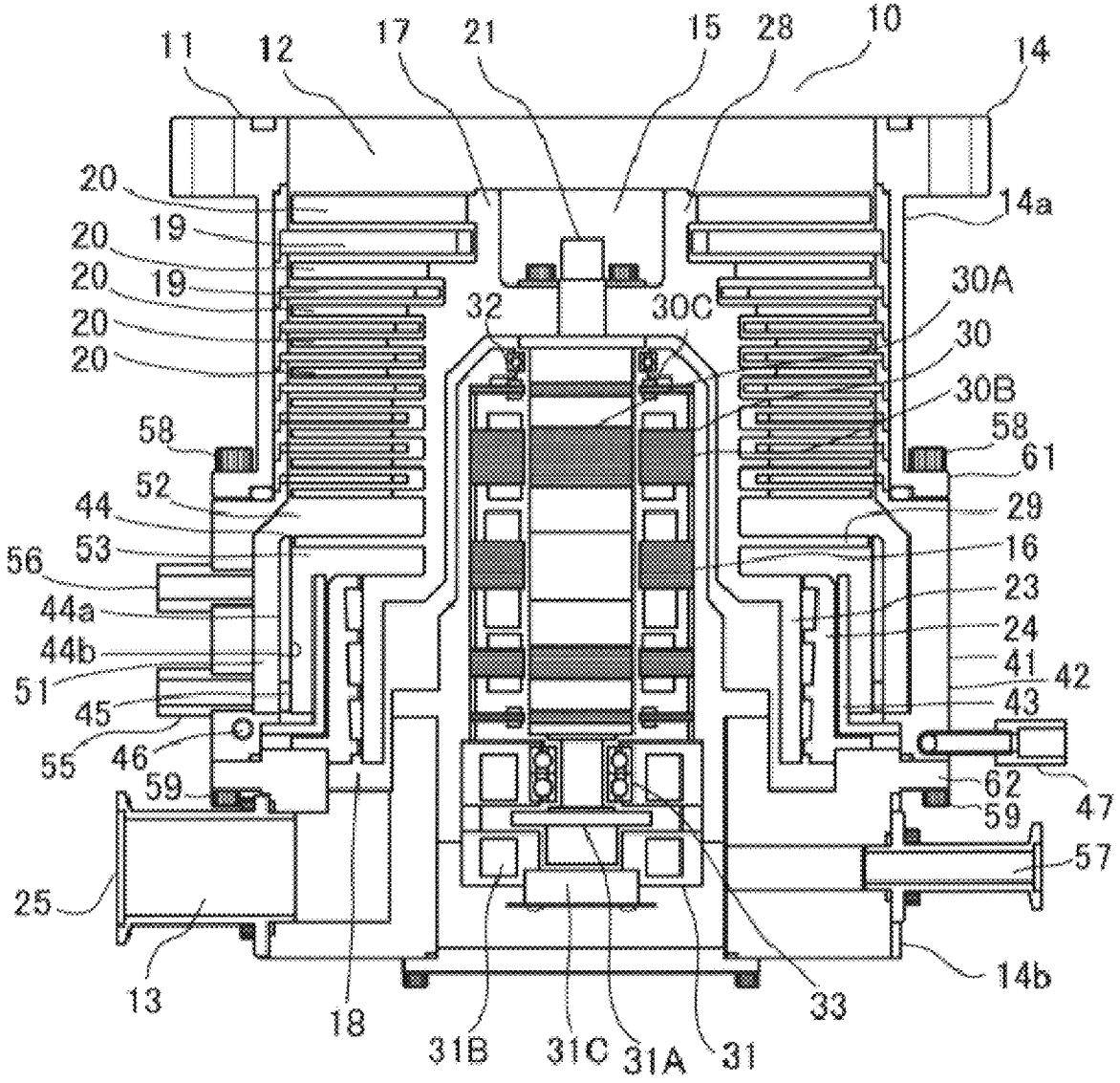
FIG. 1 is a vertical cross-sectional view of a turbomolecular pump according to a first embodiment of the present invention.

A turbomolecular pump 10 according to a first embodiment of the present invention is now described with reference to FIGS. 1, 2A and 2B. FIG. 1 schematically shows a vertical cross section of the turbomolecular pump 10 as a vacuum pump according to the first embodiment of the present invention. The turbomolecular pump 10 is connected to a vacuum chamber (not shown) of a target device such as a semiconductor manufacturing device, an electron microscope, or a mass spectrometer.

The turbomolecular pump 10 integrally has a cylindrical pump main body 11 and a box-shaped electrical equipment case (not shown). Of these components, the pump main body 11 has an inlet portion 12 on the upper side in FIG. 1 which is connected to a side of the target device, and an outlet portion 13 on the lower side which is connected to an auxiliary pump or the like. The turbomolecular pump 10 can be used not only in a vertical posture in a vertical direction as shown in FIG. 1, but also in an inverted posture, a horizontal posture, and an inclined posture.

A power supply circuit portion for supplying electric power to the pump main body 11 and a control circuit portion for controlling the pump main body 11 are accommodated in the electrical equipment case (not shown), but the detailed descriptions thereof are omitted herein.

The pump main body 11 has a substantially cylindrical main body casing 14. The inside of the main body casing 14 is provided with an exhaust mechanism portion 15 and a rotary drive portion (referred to as "motor," hereinafter) 16. Of these components, the exhaust mechanism portion 15 is of a composite type composed of a turbomolecular pump mechanism portion 17 functioning as a pump mechanism portion, and a thread groove pump mechanism portion 18 functioning as a thread groove exhaust mechanism portion.

The turbomolecular pump mechanism portion 17 and the thread groove pump mechanism portion 18 are arranged in a continuous manner in an axial direction of the pump main body 11; in FIG. 1, the turbomolecular pump mechanism portion 17 is disposed on the upper side in FIG. 1 and the thread groove pump mechanism portion 18 is disposed on the lower side in FIG. 1. Basic structures of the turbomolecular pump mechanism portion 17 and the thread groove pump mechanism portion 18 are schematically described hereinafter.

The turbomolecular pump mechanism portion 17 disposed on the upper side in FIG. 1 transfers gas using a large number of turbine blades, and includes stationary blades (referred to as "stator blades," hereinafter) 19 and a rotating blades (referred to as "rotor blades," hereinafter) 20 that each have a predetermined inclination or curved surface and are formed radially. In the turbomolecular pump mechanism portion 17, the stator blades 19 and the rotor blades 20 are arranged alternately in approximately ten stages.

The stator blades 19 are provided integrally on the main body casing 14, and the rotor blades 20 are arranged above and below the respective stator blades 19. The rotor blades 20 are integrated with a tubular rotor 28 which is a vacuum pump component, the rotor 28 being concentrically fixed to a rotor shaft 21 in such a manner as to cover the outside of the rotor shaft 21. When the rotor shaft 21 rotates, the rotor blades 20 rotate in the same direction as the direction where the rotor shaft 21 and the rotor 28 rotate.

Here, aluminum is used as the material of the main components of the pump main body 11. The materials of an outlet-side casing 14*b* which is described hereinafter, the stator blades 19, the rotor 28 and the like are also aluminum. In FIG. 1, the illustration of the hatch showing the cross sections of components of the pump main body 11 are omitted in order to prevent the drawings from becoming complicated.

A partition wall 29 functioning as the partition wall portion is formed in a rotor cylindrical portion 23 of the rotor 28. The partition wall 29 is formed integrally at a part of the rotor 28 located in the middle in the axial direction, and protrudes in a radial direction at a lower portion of the rotor blades 20 shown in FIG. 1. The amount of protrusion of the partition wall 29 from the rotor 28 is set so as to be uniform over the entire circumference.

The partition wall 29 is also configured to guide the gas to a cooling trap portion 41 which is described hereinafter. As with the rotor 28 and the like, the material of the partition wall 29 is aluminum. The partition wall 29 is configured to guide the gas radially outward (in a centrifugal direction) while functioning as a rotating disc that rotates integrally with the rotor 28 as the rotor 28 rotates.

The rotor shaft 21 is processed into the shape of a column having steps, and reaches from the turbomolecular pump mechanism portion 17 to the thread groove pump mechanism portion 18 therebelow. The motor 16 is disposed in an axiallycentral portion of the rotor shaft 21. The motor 16 is described hereinafter.

The thread groove pump mechanism portion 18 includes the rotor cylindrical portion 23 and a thread stator 24. The rotor cylindrical portion 23 and the thread stator 24 are described hereinafter in detail. An outlet port 25 to be connected to an exhaust pipe is disposed below the thread groove pump mechanism portion 18, and the inside of the outlet port 25 and the thread groove pump mechanism portion 18 are spatially connected.

The cooling trap portion 41 (described hereinafter) is provided in an outer peripheral portion of the thread groove pump mechanism portion 18. The rotor cylindrical portion 23 of the thread groove pump mechanism portion 18 is integrally formed on the rotor 28. Furthermore, the rotor cylindrical portion 23 is formed in such a manner as to extend concentrically in the radial direction from a lower end portion of the rotor 28 shown in FIG. 1.

Figure 2A:
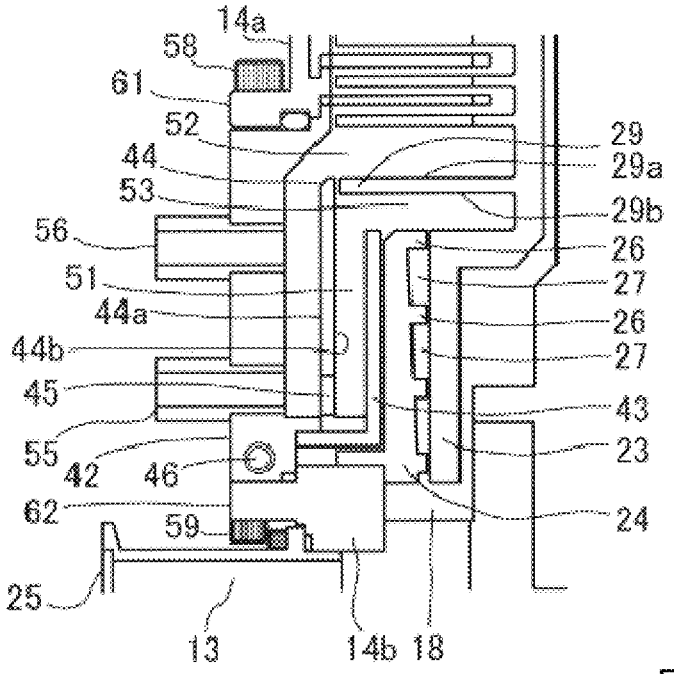
FIG. 2A is a vertical cross-sectional view showing an enlargementof a part of the turbomolecular pump according to the first embodiment.
Figure 2B:
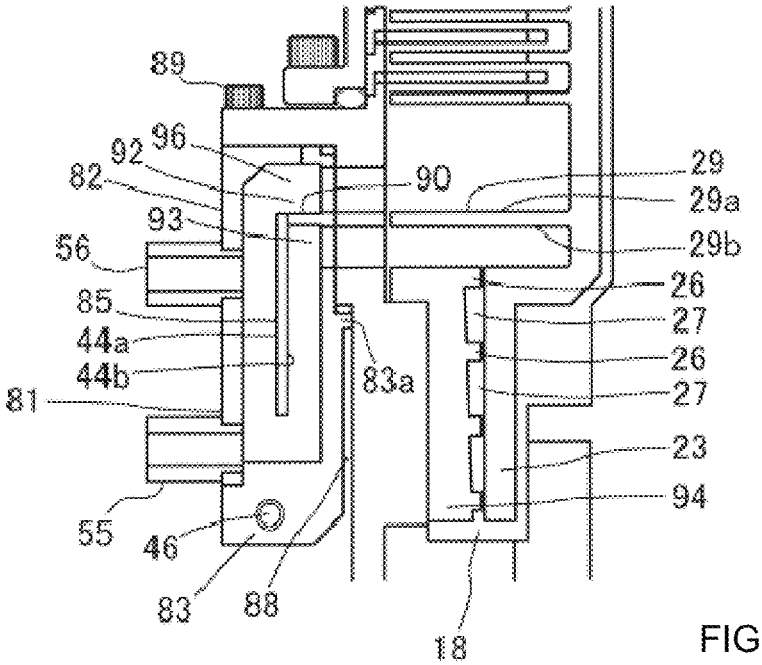
FIG. 2B is a vertical cross-sectional view showing an enlargement of a part of a turbomolecular pump according to a second embodiment.

FIG. 2A shows an enlarged cross section, wherein the thread stator 24 is formed in a tubular shape and covers the outside of the rotor cylindrical portion 23 over the entire circumference. A plurality of curved tooth-shaped spiral wall portions 26 are formed on an inner peripheral surface of the thread stator 24 along the axial direction (from the upper side to the lower side in FIG. 1) at a predetermined torsion angle. In addition, thread groove portions 27 separated by the spiral wall portions 26 are formed between the spiral wall portions 26.

In the thread stator 24, the distance between the spiral wall portions 26 changes so as to become gradually narrow, from the upper side to the lower side in FIGS. 1 and 2A. Therefore, the width of each thread groove portion 27, too, changes so as to become gradually narrow, from the upper side to the lower side in FIG. 1. The thread stator 24 is fixed to the outlet-side casing 14*b* so as not to bring the spiral wall portions 26 into contact with the rotor cylindrical portion 23, when tips of the spiral wall portions 26 or the thread groove portions 27 face the rotor cylindrical portion 23.

Here, a typical thread stator known as Holbek can be employed as the thread stator 24. Furthermore, in FIG. 2A, the cross section of the spiral wall portions 26 is shown without hatching so as not to complicate the illustration, Aluminum is adopted as the material of the thread stator 24.

The motor 16 described above includes a rotator (reference numeral thereof is omitted) fixed to an outer periphery of the rotor shaft 21, and a stator (reference numeral thereof is omitted) disposed so as to surround the rotator. The electric power for activating the motor 16 is supplied by the power supply circuit portion or the control circuit portion accommodated in the electrical equipment case (not shown) described above.

Magnetic bearings, which are non-contact type bearings by magnetic levitation, are used to support the rotor shaft 2L Two sets of radial magnetic bearings (radial direction magnetic bearings) 30 arranged above and below the motor 16 and one axial magnetic bearing (axial direction magnetic bearing) 31 arranged below the rotor shaft 21 are used as the magnetic bearings.

Of these magnetic bearings, each radial magnetic bearing 30 includes a radial electromagnet target 30A formed on the rotor shaft 21, a plurality of (two, for example) radial electromagnets 30B facing the radial electromagnet target, a radial displacement sensor 30C, and the like. The radial displacement sensor 30C detects a radial displacement of the rotor shaft 21. Then, based on the output of the radial displacement sensor 30C, excitation currents of the radial electromagnets 30B are controlled, and the rotor shaft 21 is supported in a levitating manner, so as to be able to rotate about the shaft center at a predetermined radial position.

The axial magnetic bearing 31 includes a disk-shaped armature disk 31A attached to a lower end portion of the rotor shaft 21, axial electromagnets 31B vertically opposed to each other with the armature disk 31A therebetween, an axial displacement sensor 31C installed slightly away from a lower end surface of the rotor shaft 21, and the like. The axial displacement sensor 31C detects an axial displacement of the rotor shaft 21. Then, based on the output of the axial displacement sensor 31C, excitation currents of the upper and lower axial electromagnets 31B are controlled, and the rotor shaft 21 is supported in a levitating manner, so as to be able to rotate about the shaft center at a predetermined axial position.

Use of the radial magnetic bearings 30 and the axial magnetic bearing 31 can realize an environment where the rotor shaft 21 (and the rotor blades 20) is not worn out and has a long life in spite of high speed rotation, eliminating the need of lubricating oil. Furthermore, in the present embodiment, by using the radial displacement sensor 30C and the axial displacement sensor 31C, the rotor shaft 21 rotates freely only in a rotational direction (θz) around the axial direction (Z direction), and positional control is performed on the rotor shaft 21 in the other five axial directions, that is, X, Y, Z, θx, and θy directions.

Furthermore, radial protective bearings (also referred to as "protective bearings," "touch-down (T/D) bearings," "backup bearings," etc.) 32, 33 are arranged around upper and lower portions of the rotor shaft 21 at predetermined intervals. For example, even in case of trouble in an electrical system or trouble such as atmospheric entry, these protective bearings 32, 33 do not cause significant changes in the position and posture of the rotor shaft 21, preventing damage from occurring on the rotor blades 20 and surrounding portions thereof.

The abovementioned cooling trap portion 41 is described next. The cooling trap portion 41 is formed in an annular shape so as to cover an outer periphery of the thread groove pump mechanism portion 18 by combining an outer body portion 42, an inner body portion 43, a cooling plate 44, and the like. Aluminum is employed as the material for the outer body portion 42, the inner body portion 43, and the cooling plate 44.

The outer body portion 42 constitutes a part (an axial intermediate portion) of the main body casing 14, and the inner body portion 43 faces an outer periphery of the thread stator 24 of the thread groove pump mechanism portion 18. Specifically, in the present embodiment, the main body casing 14 is configured by serially arranging an inlet-side casing 14*a* located at an upper portion in FIG. 1, the outer body portion 42 of the cooling trap portion 41, and the outlet-side casing 14*b* located at the lower side in FIG. 1. Also, the cooling trap portion 41 is configured to cool the gas in the main body casing 14 as described hereinafter.

Moreover, a cooling water flow path 46 for circulating cooling water is formed in art annular shape inside the outer body portion 42, and cooling water (not shown) is introduced into the cooling water flow path 46 via a cooling water pipe 47. The cooling water introduced into the cooling water flow path 46 removes heat from the outer body portion 42 and each component (the inner body portion 43, the cooling plate 44, and the like) that is in contact with the outer body portion 42 in a heat transferable manner, thereby cooling the cooling trap portion 41. In FIG. 1, a cooling water pipe for letting the cooling water out (not shown) is hidden behind the main body casing 14.

The cooling plate 44 is provided upright, with a plate surface thereof facing outward and inward in the radial direction of the main body casing 14. A base end portion (the lower part in FIGS. 1 and 2A) of the cooling plate 44 is processed to have an L-shaped cross section, and is fixed while being held between the outer body portion 42 and the inner body portion 43. An upper end portion of the cooling plate 44 (the upper part in FIGS. and 2A) reaches approximately the same position as the partition wall 29 described above, and faces the partition wall 29 through a gap small enough to prevent gas leakage, without coming into contact with the partition wall 29.

On the base end side of the cooling plate 44, a flow hole portion 45 is provided in such a manner as to penetrate the cooling plate 44 in a thickness direction, and the spaces outside and inside the cooling plate 44 are connected so that the gas can flow. Then, a trap flow path 51 that extends from the space on the upper surface side of the partition wall 29 to reach the space on the lower surface side of the partition wall 29 through the outside of the cooling plate 44, the flow hole portion 45, and the inside of the cooling plate 44, is formed inside the cooling trap portion 41.

In the trap flow path 51, the part on the upper surface side of the partition wall 29 is configured as an annular trap inflow port 52 (the first inflow port of the first inflow and outflow ports) of the trap flow path 51. In addition, the part on the lower surface side of the partition wall 29 is configured as an annular trap outflow port 53 (the first outflow port of the first inflow and outflow ports) of the trap flow path 51. The gas that is led out from the turbomolecular pump mechanism portion 17 is guided by the partition wall 29 and flows into the trap inflow port 52.

Also, the gas that flows into the trap inflow port 52 passes through outside and the inside of the cooling plate 44 in the trap flow path 51, and flows out from the trap inflow port 52 toward the thread groove pump mechanism portion 18. Here, the trap inflow port 52 and the trap outflow port 53 may be continuously opened over the entire circumference or may be intermittently opened.

As shown on the left side in FIG. 1 (FIG. 2A shows the enlarged cross section), in the cooling trap portion 41, a member constituting a cleaning fluid inflow pipe 55 (the second inflow port of the second inflow and outflow ports) and a cleaning fluid outflow pipe 56 (the second outflow port of the second inflow and outflow ports) are connected. The cleaning fluid inflow pipe 55 and the cleaning fluid outflow pipe 56 are normally closed by a valve or the like so that cleaning fluid does not flow therethrough. However, in order to clean the inside of the cooling trap portion 41, the cleaning fluid (not shown) is introduced into the trap flow path 51 via the cleaning fluid inflow pipe 55 in a state in which the operation of the turbomolecular pump 10 is stopped.

In a case where the turbomolecular pump 10 is installed in the manner shown in FIG. 1 (vertically with the inlet portion 12 facing up), the cleaning fluid inflow pipe 55 and the cleaning fluid outflow pipe 56 are arranged in such a manner that the position of the cleaning fluid inflow pipe 55 is lower than the position of the cleaning fluid outflow pipe 56. In addition, standardized pipes and joints are used as the cleaning fluid inflow pipe 55 and the cleaning fluid outflow pipe 56.

The cleaning fluid outflow pipe 56 is disposed in such a manner that the position of the cleaning fluid outflow pipe 56 is lower than the position of the partition wall 29, as shown in FIG. 1. In addition, the cleaning fluid that is supplied to the cooling trap portion 41 via the cleaning fluid inflow pipe 55 and passes through the trap flow path 51 pools in the trap flow path 51 and is discharged to the outside of the turbomolecular pump 10 via the cleaning fluid outflow pipe 56. The cleaning fluid then circulates between the trap flow path 51 and the outside of the turbomolecular pump 10.

By supplying the cleaning fluid into the trap flow path 51 and circulating the cleaning fluid in this manner, the cleaning fluid inflow pipe 55, the cleaning fluid outflow pipe 56, and a cleaning fluid flow path leading to these pipes function as a cleaning portion (deposit removal portion that exerts the deposit removal function). The cooling trap portion 41 can be cleaned without being removed from the main body casing 14. Moreover, the cooling plate 44 is provided inside the cooling trap portion 41, and a large contact area is secured between the gas and the cooling trap portion 41. However, a large area inside the cooling trap portion 41 (area where deposits can adhere) can be cleaned efficiently using the cleaning fluid.

In addition, since the cleaning fluid outflow pipe 56 located higher among the cleaning fluid outflow pipe 56 and the cleaning fluid inflow pipe 55 is disposed lower than the partition wall 29, the fluid level of the cleaning fluid can be prevented from reaching the partition wall 29 or thereabove. Consequently, the cleaning fluid can be prevented from overflowing above the partition wall 29 due to the fluid level of the cleaning fluid reaching above the partition wall 29.

In the cooling trap portion 41, the above-mentioned cooling water pipe 47, cleaning fluid inflow pipe 55, and cleaning fluid outflow pipe 56 that are connected all protrude outward in the radial direction (in the centrifugal direction) of the main body casing 14. Also, the outlet port 25 and a purge port 57 are provided below the cooling trap portion 41 and also protrude outward in the radial direction (in the centrifugal direction) of the main body casing 14.

The purge port 57 constitutes a flow path for purge gas ($N_2$ gas). The purge gas introduced through the purge port 57 forms an upward flow in the spaces between the radial electromagnetic target 30A and the radial electromagnets 30B. Then, the gas containing sedimentary components is discharged by the flow of the purge gas, washing away the sedimentary components trying to accumulate.

The components adjacent to the cooling trap portion 41 (the inlet-side casing 14*a* and the outlet-side casing 14*b*) are fixed to the cooling trap portion 41 using hex socket screws 58, 59. Specifically, as shown in FIGS. 1 and 2A, a flange portion 61 of the inlet-side casing 14*a* and the cooling trap portion 41 (the outer body portion 42) are coupled to each other by the hex socket screw 58 having a relatively large diameter. On the other hand, a flange portion 62 of the outlet-side casing 14*b* and the cooling trap portion 41 (again, the outer body portion 42) are coupled to each other by the hex socket screw 59 having a relatively small diameter.

By loosening the large-diameter hex socket screw 58 and detaching the hex socket screw 58 from the cooling trap portion 41, the inlet-side casing 14*a* and the cooling trap portion 41 can be separated from each other. On the other hand, by loosening the small-diameter hex socket screw 59 and detaching the hex socket screw 59 from the cooling trap portion 41, the outlet-side casing 14*b* and the cooling trap portion 41 can be separated from each other.

In a case where it is assumed that deposits have accumulated in the cooling trap portion 41 to the extent that the cooling trap portion 41 cannot be cleaned sufficiently with the cleaning fluid, the cooling trap portion 41 can be removed, disassembled, and cleaned. As a result of removing the cooling trap portion 41, the thread groove pump mechanism portion 18 covered and hidden by the cooling trap portion 41 becomes exposed. Therefore, in a case where deposits are adhered to the thread stator 24 of the thread groove pump mechanism portion 18, the deposits can be removed.

When the turbomolecular pump 10 with such structure is operated, the motor 16 described above is driven, and thereby the rotor blades 20 rotate. As the rotor blades 20 rotate, the gas is withdrawn from the inlet portion 12 shown on the upper side of FIG. 1, and transferred toward the thread groove pump mechanism portion 18 while causing the gas molecules to collide with the stator blades 19 and the rotor blades 20.

The gas that has been led out from the turbomolecular pump mechanism portion 17 toward the thread groove pump mechanism portion 18 is guided horizontally outward (from the center of rotation toward the centrifugal side) by an upper surface 29*a* (upstream-side gas guiding surface) of the partition wall 29 shown in FIG. 1. The gas that has been guided by the upper surface 29*a* of the rotating partition wall 29 is guided to the trap inflow port 52 and flows into the trap flow path 51 of the cooling trap portion 41.

This gas transfer is performed continuously, and the gas flowing into the trap flow path 51 reaches a side of the inner peripheral surface 44*b* of the cooling plate 44 via the flow hole portion 45 and the outer peripheral surface 44*a*. The gas in the trap flow path 51 is then cooled by heat transfer with each wall surface of the cooling trap portion 41, and flows out from the trap flow path 51 toward the partition wall 29 through the trap outflow port 53. The resultant cooled gas then flows along a lower surface 29*b* (downstream-side gas guiding surface) of the partition wall 29, is then sucked into the thread groove portions 27 described above, and is compressed by the thread groove pump mechanism portion 18.

The gas in the thread groove portions 27 enters the outlet port 25 from the outlet portion 13 and is then discharged from the pump main body 11 via the outlet port 25. Note that the rotor shaft 21, the rotor blades 20 rotating integrally with the rotor shaft 21, the rotor cylindrical portion 23, the rotator (reference numerals thereof is omitted) of the motor 16 and the like can be collectively referred to as, for example, "rotor portion" or "rotating portion."

Figure 3A:
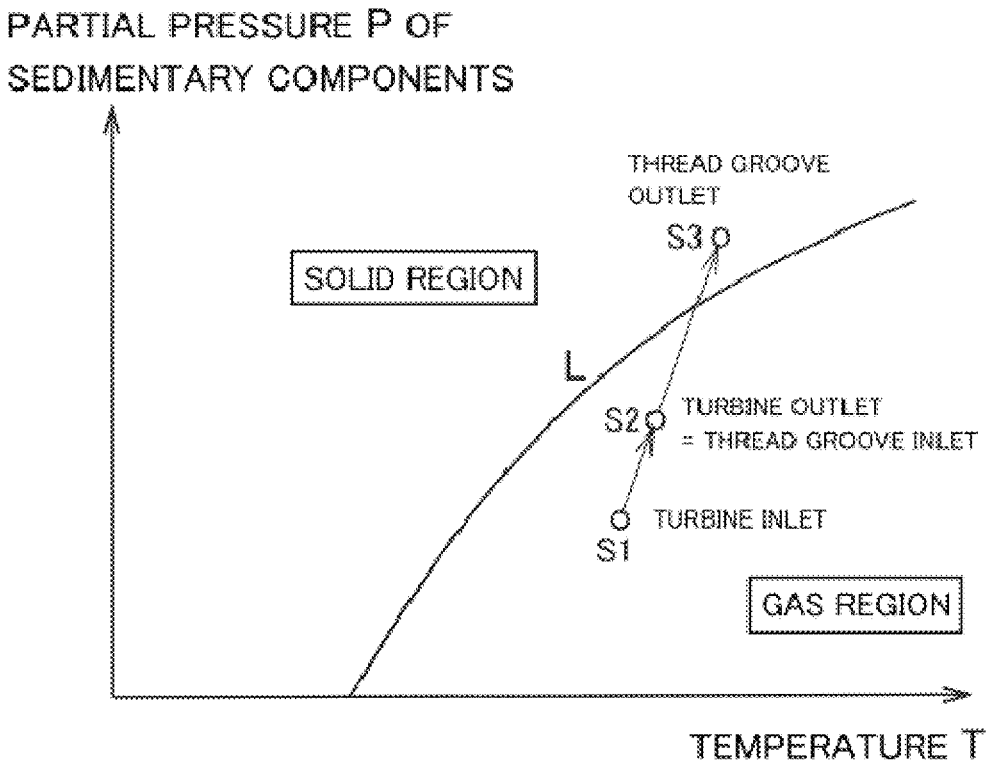
FIG. 3A is a graph showing, by means of a vapor pressure diagram, a state change of gas obtained when a cooling trap portion is not provided.

The function of the cooling trap portion 41 is described next using vapor pressure curves of FIGS. 3A and 3B. FIG. 3A shows a state change of the gas that is obtained when the cooling trap portion 41 is not provided between the turbomolecular pump mechanism portion (see reference numeral 17 in FIG. 1) and the thread groove pump mechanism portion (see reference numeral 18 in FIG. 1), and FIG. SB shows a state change obtained when the cooling trap portion 41 is provided.

The vertical axis in each diagram represents a partial pressure P of the sedimentary components in the gas, and the horizontal axis represents a temperature T of the gas. Here, since the gas in contact with the surfaces of components is cooled to the temperatures of the components, the temperatures of the components constituting the flow paths are treated as "gas temperature," for convenience. Further, in each diagram, a vapor pressure curve L shows that the partial pressure P of the sedimentary components rises smoothly in an upward convex shape as the gas temperature T rises. The upper region of the vapor pressure curve L is a region in which the sedimentary components are solid (solid region), as illustrated in words in each diagram. On the other hand, the lower region of the vapor pressure curve L is a region in which the sedimentary components are gaseous matter (gas region), as similarly illustrated in words in each diagram.

In FIG. 3A, points S1 to S3 each indicate the state of the gas transferred in the turbomolecular pump or the sedimentary components of the gas. Of these points S1 to S3, S1 (T=T1, P=P1) corresponds to the state of the gas at an inlet of the turbomolecular pump mechanism portion (referred to as "turbine inlet," hereinafter). The point S1 is located below the vapor pressure curve L, and the state of the sedimentary components at the turbine inlet corresponds to the gas region.

Next, S2 (T2, P2) corresponds to the state of the gas at an outlet of the turbomolecular pump mechanism portion (referred to as "turbine outlet," hereinafter). In the turbomolecular pump mechanism portion, the gas is compressed while being transferred. Thus, at the turbine outlet, both the gas temperature and the partial pressure of the sedimentary components are higher as compared with the turbine inlet (S1).

In the example shown in FIG. 3A, since the cooling trap portion (reference numeral 41 in FIG. 1) is not used on the gas at the turbine outlet, it is conceivable that the gas temperature is constant from the turbine outlet to an inlet of the thread groove portions (referred to as "thread groove inlet," hereinafter) (reference numeral 27 in FIG. 2A). In other words, in a case where the cooling trap portion is not provided between the turbine outlet and the thread groove inlet, it is conceivable that the relationship in which the gas temperature and the partial pressure of the sedimentary components at the turbine outlet are equal to those at the thread groove inlet.

Once the gas is transferred to the thread groove portion, the gas temperature and the partial pressure of the sedimentary components rise, whereby the state of the gas may reach the point S3. The point S3 corresponds to the state of the gas at an outlet of the thread groove portion (referred to as "thread groove outlet," hereinafter). In addition, the point S3 (T2, P2) is located above the vapor pressure curve L, and the state of the sedimentary components at the turbine outlet belongs to the solid region. Therefore, it is conceivable that the volume (precipitation) of the sedimentary components is present at the thread groove outlet and a part downstream of the thread groove outlet. When assuming that deposits accumulate in large amounts, the turbomolecular pump needs to be disassembled to perform the cleaning to remove the deposits.

Figure 3B:
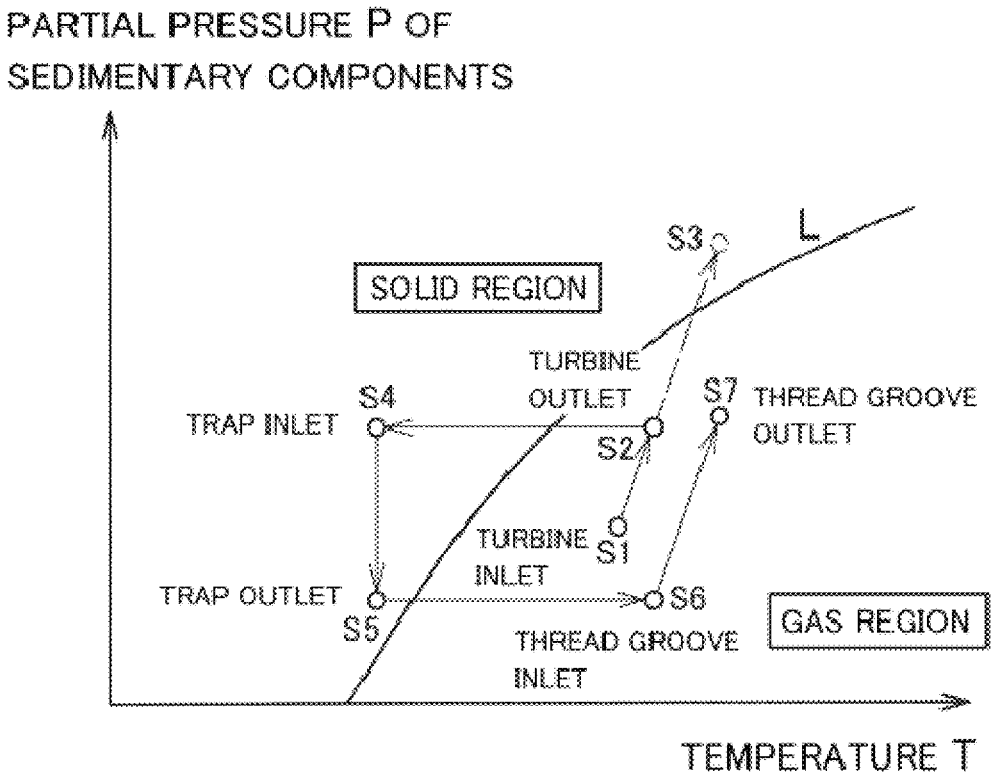
FIG. 3B is a graph showing, by means of a vapor pressure diagram, a state change of the gas obtained when the cooling trap portion is provided.

On the other hand, when using the cooling trap portion (reference numeral 41 in FIG. 1) as shown in FIG. 3B, the gas temperature can be lowered by guiding the gas that has reached the turbine outlet (S2) to the cooling trap portion. As shown by the points S4 (T4, P4) and S5 (T5, P5), the state of the gas can be shifted to the solid region on the lower temperature side of the vapor pressure curve L, the sedimentary components can be precipitated, and the partial pressure of the sedimentary components of the gas sent to the thread groove inlet (S6) can be lowered.

Specifically, the point S4 shown in FIG. 3B corresponds to the state of the gas at the inlet of the cooling trap portion (referred to as "trap inlet," hereinafter), and the point S5 corresponds to the state of the gas at an outlet of the cooling trap portion (referred to as "trap outlet," hereinafter). The point S6 corresponds to the state of the gas at the thread groove inlet, and the point S7 corresponds to the state of the gas at the thread groove outlet.

By guiding the gas of the turbine outlet to the cooling trap portion, the gas temperature drops, shifting the state of the gas from the point S3 to the point S4. Moreover, while the gas flows through the trap flow path (reference numeral 51 in FIG. 1) in the cooling trap portion, precipitation of the sedimentary components occurs in the cooling trap portion, and the partial pressure of the sedimentary components drops from P4 to P5. In FIG. 3B, the gas temperature drops to T4 at the trap inlet, establishing T4=T5 so as not to complicate the explanation. Here, since the gas in contact with the surfaces of components is cooled to the temperatures of the components as described above, the temperatures of the components constituting the flow paths are described as the "gas temperature," for convenience, and T4=T5 is established since the gas temperature at the cooling trap inlet S4 is same as that at the cooling trap outlet S5. Note that the aspect of lowering the gas temperature is not limited to the example shown in FIG. 3B.

The gas that has reached the cooling trap outlet flows out from the cooling trap portion and is guided to the thread groove inlet. Then, the gas temperature rises from T5 to T6. At this moment, the sedimentary components are solidified in the cooling trap portion, and the partial pressure P6 of the sedimentary components is lower than the partial pressure (P2) of the same at the thread groove inlet in the situation shown in FIG. 3A (when the cooling trap portion is not provided).

Thus, even when the gas is compressed by the thread groove pump mechanism portion (reference numeral 18 in FIG. 1) as in the situation shown in FIG. 3A, the partial pressure P7 of the sedimentary components is lower than P3 at the thread groove outlet. As a result, the formation of deposits at the thread groove outlet and the part downstream thereof can be prevented. Consequently, cleaning for removing the deposits becomes unnecessary, reducing the frequency of cleaning.

Moreover, by making the temperature of the cooling trap portion (trap temperature) lower than the sublimation temperature of at least one sedimentary component in the gas, precipitation of deposits in a part other than the cooling trap portion can be more efficiently prevented. Here, examples of the gas include gas whose aluminum chloride is precipitated and gas whose indium chloride having a relatively high sublimation temperature is precipitated.

According to the turbomolecular pump 10 (FIG. 1) of the first embodiment described above, since the partition wall 29 is provided in the front stage of the cooling trap portion 41, the gas can actively be guided to the cooling trap portion 41 by the partition wall 29. Also, the partition wall 29 can guide the gas to the trap inflow port 52, and further guide the gas flowing out from the trap outflow port 53 via the cooling trap portion 41 to the downstream side. Thus, compared with, for example, the turbomolecular pumps disclosed in Japanese Patent No. 4211320 and Japanese Patent No. 4916655 mentioned above, the entire gas can be cooled efficiently by the interaction between the partition wall 29 and the cooling trap portion 41 without dividing the gas.

In addition, since the gas is guided to the cooling trap portion 41 by the partition wall 29, the exhaust flow path can be formed in such a manner that the exhaust flow path curves (deviates) once and returns to the upstream of the thread groove pump mechanism portion 18 via the cooling trap portion 41 instead of extending in a straight line. The gas flow paths in the front stage of the thread groove pump mechanism portion 18, such as the trap inflow port 52, the trap outflow port 53, the cooling trap portion 41, and the trap flow path 51 inside the cooling trap portion 41, are not required to bring about a compression function, and therefore are not likely to be restricted in size. For this reason, by making the gas flow paths of the front stage of the thread groove pump mechanism portion 18 sufficiently large, the exhaust flow path can be prevented from being clogged by deposits as compared with the turbomolecular pump disclosed in Japanese Patent Application Laid-Open No. 2003-254284 mentioned above. Consequently, the cooling trap portion 41 can be maintained less frequently.

The trap inflow port 52 and the trap outflow port 53 are located above and below the partition wall 29, and the trap inflow port 52 and the trap outflow port 53 are separated by the partition wall 29. Therefore, the collision between the inliowing gas and the outflowing gas can be prevented, enabling smooth circulation of the gas, Consequently, the gas can be supplied reliably to the cooling trap portion 41.

Since the partition wall 29 is provided between the turbomolecular pump mechanism portion 17 and the thread groove pump mechanism portion 18, even if, for example, some dust is contained in the gas led out from the turbomolecular pump mechanism portion 17, the partition wall 29 can prevent the dust from entering a side of the thread groove pump mechanism portion 18.

Furthermore, since the cooling plate 44 is provided in the cooling trap portion 41, a large contact area can be secured between the gas and the cooling trap portion 41. Consequently, the gas can be cooled efficiently.

In addition, generally, although the temperature of the gas in the turbomolecular pump 10 is higher than the atmospheric temperature, the heat is released to the atmosphere side through the outer body portion 42 of the cooling trap portion 41 since the outer body portion 42 faces the atmosphere side. Consequently, the gas can be cooled efficiently.

Moreover, the cooling trap portion 41 extends so as to face the outer periphery of the thread stator 24 of the thread groove pump mechanism portion 18, and is located in a position that is unlikely to be affected by heat coming from the inside of the pump as compared with the turbomolecular pump disclosed in Japanese Patent Application Laid-open No. 2003-254284. Thus, the gas can be cooled efficiently. For example, it is unlikely that the cooled gas in the cooling trap portion 41 is affected by the heat coming from the inside of the pump and thereby reheated.

More specifically, according to the cooling trap portion 41 of the first embodiment, the temperature of the cooling trap portion 41 itself can be lowered efficiently. This is because more heat can be dissipated by the casing (such as the outer body portion 42) of the cooling trap portion 41 to be water-cooled, or because the pump casings (such as the inlet-side casing 14*a*, the outlet-side casing) to which the cooling trap portion 41 is attached is unlikely to reach a high temperature, so heat transfer from these pump casings takes place less frequently.

Also, according to the cooling trap portion 41 of the first embodiment, the gas can be cooled efficiently. This is because since the cooling trap portion 41 is separated from the high temperature portions inside the pump (the heat generating members such as the motor 16, high temperature-side members such as the thread groove pump mechanism portion 18, etc.), the cooling trap portion 41 is not easily affected by the heat.

Moreover, according to the turbomolecular pump 10 of the first embodiment, in the cooling trap portion 41, the state of the gas is guided to the solid region, and the gas temperature can be rapidly lowered to the sublimation temperature (solidification temperature) of the sedimentary components or lower, as shown in FIG. 3B. Accordingly, the sedimentary components (deposits) in the gas can be captured by the cooling trap portion 41, reducing the partial pressure of the gas.

Therefore, as shown in FIG. 3B, even if the temperature of the gas flowing out from the trap outlet rises (T5→T6→T7), the state of the gas (S4) at the thread groove outlet can remain in the gas region. As a result, the formation of deposits and increase thereof at the thread groove outlet and the section downstream thereof can be prevented. As a result, the cooling trap portion 41 requires less maintenance.

A turbomolecular pump 80 according to a second embodiment of the present invention is described next with reference to FIGS. 4 and 2B. The same portions as those in the first embodiment are denoted by the same reference numerals; the descriptions thereof will be omitted accordingly. In the second embodiment illustrated in FIG. 4 (and FIG. 2B), an outlet-side casing 84*b* covers the outside of the thread groove pump mechanism portion 18, and a cooling trap portion 81 protrudes to the outside of a main body casing 84 (an inlet-side casing 84*a* and the outlet-side casing 84*b*).

The cooling trap portion 81 is formed into an annular shape by combining and joining an outer-body portion 82 and an inner body portion 83 that are made of aluminum. In addition, the cooling trap portion 81 is unitized, and is fixed to adjacent parts (in this case, the inlet-side casing 84*a* and the outlet-side casing 84*b*) by using a plurality of (only two are shown) hex socket screws 89.

These hex socket screws 89 are inserted into a flange portion 87 of the inlet-side casing 84*a* and screwed to the cooling trap portion 81. The cooling trap portion 81 is pulled up by tightening each of the hex socket screws 89. The cooling trap portion 81 is fixed to the inlet-side casing 84*a* and the outlet-side casing 84*b* while facing the outlet-side casing 84*b*. Moreover, in the cooling trap portion 81, a projection 83*a* (FIG. 2B) formed on the inside of the inner body portion 83 is brought into contact with the outlet-side casing 84*b*, and a small gap 88 functioning as an air layer is interposed between the cooling trap portion 81 and the outlet-side casing 84*b*.

The cooling trap portion 81 and the outlet-side casing 84*b* are not coupled to each other by a screw fastener such as a hex socket screw. For this reason, the cooling trap portion 81 can be removed from the main body casing 84 as a single unit by simply loosening all of the hex socket screws 89 connecting the inlet-side casing 84*a* and the cooling trap portion 81. The cooling trap portion 81 can therefore be attached and detached without removing the inlet-side casing 84*a* and the outlet-side casing 84*b*.

Further, the cooling water flow path 46 for circulating the cooling water is formed in an annular shape in the inner body portion 83, wherein the cooling water is introduced into the cooling water flow path 46 via the cooling water pipe 47. The cooling water removes heat from the inner body portion 83 and each component that is in contact with the inner body portion 83 in a heat transferable manner, thereby cooling the cooling trap portion 81. Here, in FIG. 1, the cooling water pipe for letting the cooling water out is hidden behind the main body casing 84.

The cooling trap portion 81 is provided with an aluminum cooling plate 85 in a downwardly suspended manner, with a plate surface thereof facing outward and inward in the radial direction of the main body casing 84. An upper end portion of the cooling plate 85 is fixed to a compartment portion 90 in the cooling trap portion 81. A flow portion 86 functioning as a gas flow path is formed between a lower end portion of the cooling plate 85 and a bottom portion of the inner body portion 83.

A trap inflow port 92 (the first inflow port of the first inflow and outflow ports) and a trap outflow port 93 (the first outflow port of the first inflow and outflow ports) are opened above and below the compartment portion 90 shown in FIG. 4. Furthermore, the compartment portion 90 and the partition wall 29 are arranged at the same height in FIG. 1. The trap inflow port 92 and the trap outflow port 93 penetrate through a wall portion of the outlet-side casing 84*b* and the inner body portion 83 of the cooling trap portion 81. A trap flow path 96 that extends from the trap inflow port 92 to the trap outflow port 93 through the outside of the cooling plate 85, the flow portion 86, and the inside of the cooling plate 85 is formed inside the cooling trap portion 81.

Figure 4:
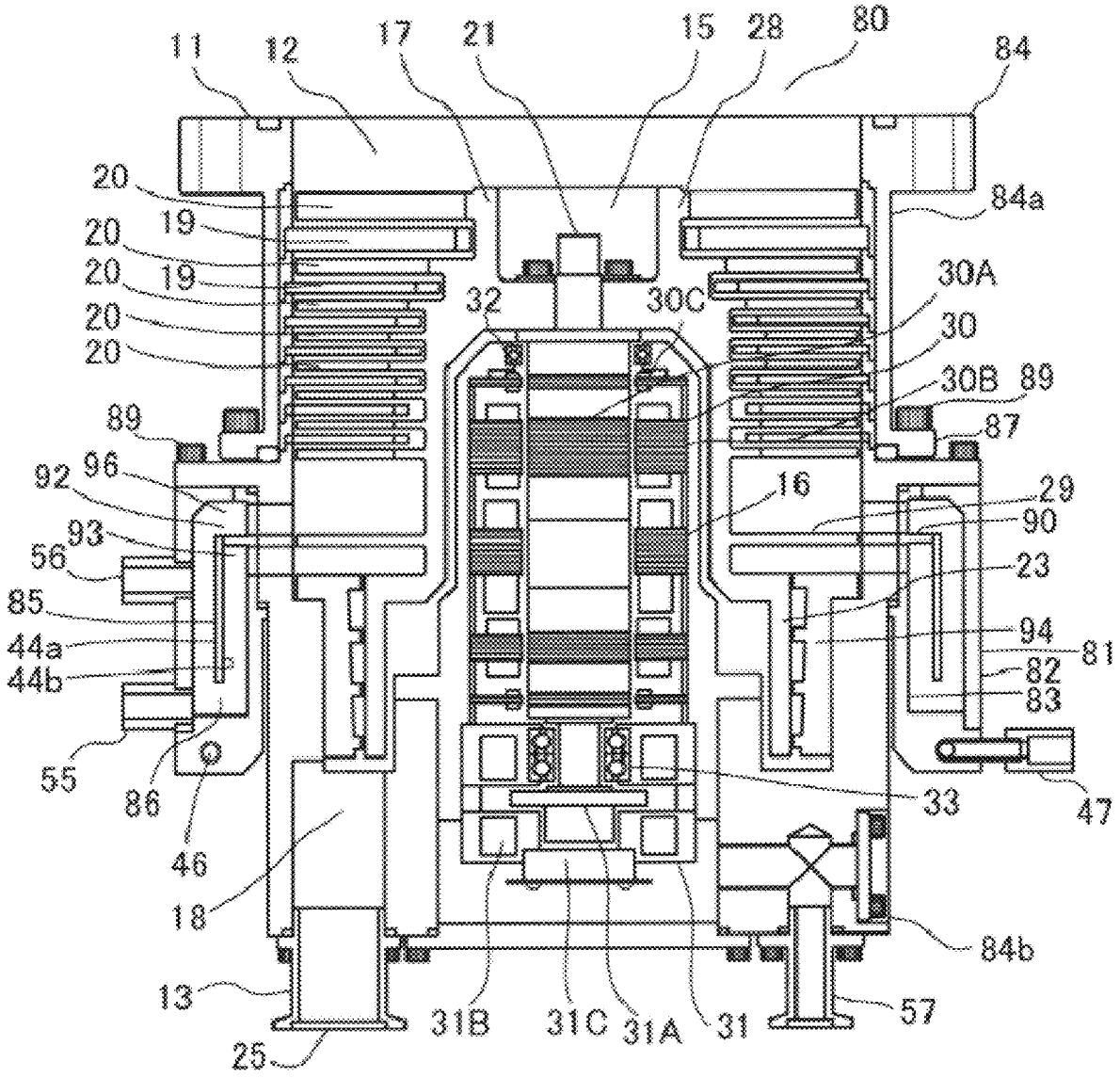
FIG. 4 is a vertical cross-sectional view of the turbomolecular pump according to the second embodiment of the present invention.
Figure 5:
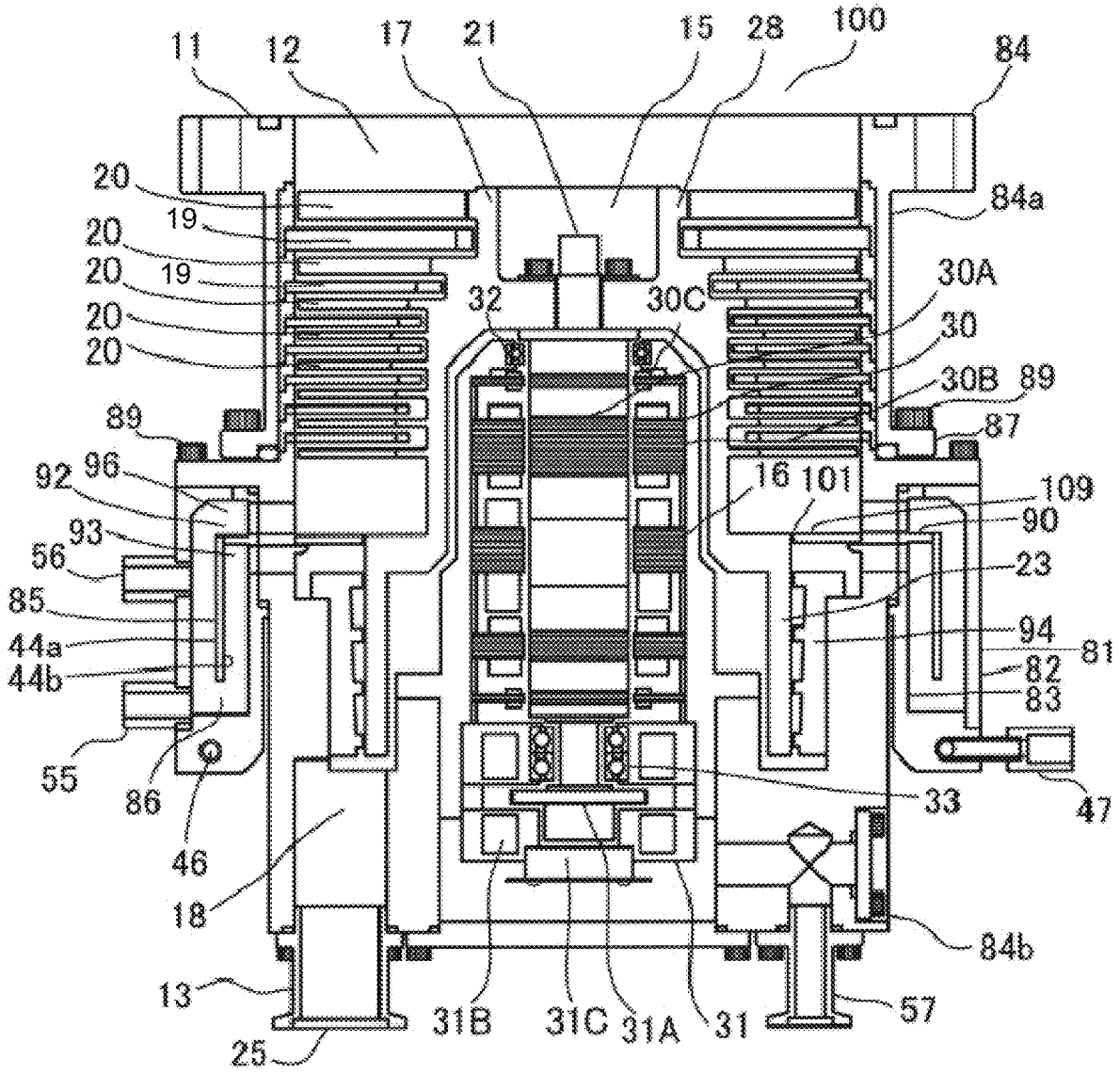
FIG. 5 is a vertical cross-sectional view a turbomolecular pump according to a third embodiment of the present invention.

The trap inflow port 92 described above faces a part on the upper surface side of the partition wall 29 shown in FIG. 4, and the trap outflow port 93 faces a part on the lower surface side of the partition wall 29. Also, the gas that is led out from the turbomolecular pump mechanism portion 17 is guided by the partition wall 29 and enters the cooling trap portion 81 from the trap inflow port 92. Then, the gas inside the cooling trap portion 81 returns from the trap outflow port 93 into the main body casing 84.

A thread stator 94 is provided below the partition wall 29 shown in FIGS. 4 and 2B. As with the thread stator 24 (FIG. 1) of the first embodiment, the thread stator 94 of the second embodiment is formed in a tubular shape and covers the outside of the rotor cylindrical portion 23 over the entire circumference. The plurality of curved tooth-shaped spiral wall portions 26 are formed on an inner peripheral surface of the thread stator 94 along the circumferential direction at a predetermined torsion angle. In addition, thread groove portions 27 separated by the spiral wall portions 26 are formed between the spiral wall portions 26.

The upper portion of the thread stator 24 in FIG. 4 is disposed so as to face the above-mentioned trap outflow port 93. Then, the thread stator 24 takes the cooled gas that has flowed out from the trap outflow port 93, into the thread groove portions 27 (FIG. 2B) and guides said gas downward while compressing said gas as the rotor cylindrical portion 23 rotates. The compression action of the rotor cylindrical portion 23 and the thread stator 24 is the same as that described in the first embodiment.

Furthermore, in the second embodiment, the outlet port 25 and the purge port 57 protrude downward from the outlet-side casing 84*b* of the main body casing 84 while facing in the axial direction (lower side in FIG. 4). The gas in the thread groove portions 27 enters the outlet port 25 from the outlet portion 13 and is then discharged from the pump main body via the outlet port 25.

According to the turbomolecular pump 80 of the second embodiment described above, the cooling trap portion 81 is mounted on the outside of the main body casing 84, and the cooling trap portion 81 is located outside the outlet-side casing 84*b*. In addition, the cooling trap portion 81 can be separated from both the inlet-side casing 84*a* and the outlet-side casing 84*b* simply by loosening the hex socket screws 89 connecting the cooling trap portion 81 and the inlet-side casing 84*a*. The cooling trap portion 81 can be removed without removing the inlet-side casing 84*a* and the outlet-side casing 84*b*.

Therefore, removal and attachment of the cooling trap portion 81 can be performed easily. Also, the outlet-side casing 84*b* covers the outside of the thread groove pump mechanism portion 18, so even if the cooling trap portion 81 is removed, significant exposure of the thread groove pump mechanism portion 18 can be prevented as compared with the first embodiment. In view of these facts, the turbomolecular pump 80 can be operated as follows.

For example, when cleaning the cooling trap portion 81, the operation of the turbomolecular pump 80 is stopped so that the turbomolecular pump mechanism portion 17 stops. In addition, the cooling trap portion 81 is replaced with a new cooling trap portion 81. Thereafter, the operation of the turbomolecular pump 80 is restarted, and at the same time the removed cooling trap portion 81 is cleaned to prepare for the replacement of the next cooling trap portion 81.

Also, the outlet-side casing 84*b* of the main body casing 84 and the inner body portion 83 of the cooling trap portion 81 are opposed to each other, and the size of the part connected to the cooling trap portion 81 is kept to the area corresponding to roughly the sum of the trap inflow port 92 and the trap outflow port 93. Therefore, the size of the opening obtained after removing the cooling trap portion 81 can be reduced more as compared with the first embodiment in which the inlet-side casing 14*a*, the outer body portion 42 of the cooling trap portion 41, and the outlet-side casing 14*b* are arranged in series in the axial direction. Consequently, the cooling trap portion 81 can be removed without opening the main body casing 84 wide.

According to the turbomolecular pump 80 of the second embodiment, since the gap 88 (FIG. 2B) is formed between the cooling trap portion 81 and the outlet-side casing 84*b*, the contact area between the cooling trap portion 81 and the outlet-side casing 84*b* can be prevented from becoming excessively large. Consequently, the temperature of the thread groove pump mechanism portion 18 and the temperature of the cooling trap portion 81 can be kept favorably. Thus, precipitation of deposits in the thread groove pump mechanism portion 18 and insufficient cooling of the cooling trap portion 81 can be prevented.

In addition, since the cooling trap portion 81 is disposed outside the outlet-side casing 84*b*, more heat is dissipated from the parts such as the outer body portion 82 to the atmosphere side so that the cooling trap portion 81 receives less impact of the heat from the turbomolecular pump 80 (from the surrounding parts). Therefore, the gas can be cooled efficiently.

In addition, according to the turbomolecular pump 80 of the second embodiment, since the outlet port 25 and the purge port 57 face the axial direction of the main body casing 84 (lower side in FIG. 1), when removing the annular cooling trap portion 81 from the main body casing 84 or attaching said cooling trap portion 81 to the main body casing 84, the outlet port 25 and the purge port 57 can be prevented from interfering with the cooling trap portion 81. Thus, the cooling trap portion 81 can be attached/detached easily.

A turbomolecular pump 100 according to a third embodiment of the present invention to a turbomolecular pump 150 according to an eight embodiment are described next with reference to FIGS. 5 to 10. The same parts as those illustrated in the first embodiment and the second embodiment are denoted by the same reference numerals; the descriptions thereof will be omitted accordingly.

First, in the first embodiment and the second embodiment, the partition wall 29 (FIG. 1, FIG. 2A, FIG. 2B, FIG. 4) is integrally processed on the rotor cylindrical portion 23. In the third embodiment shown in FIG. 5, on the other hand, a partition wall 109 functioning as the partition wall portion (and vacuum pump component) is circularly processed as a component separate from the rotor cylindrical portion 23, and is fixed concentrically to the outlet-side casing 84*b* by means of screwing (bolting) and the like (not shown).

A gap 101 small enough to be able to prevent shortcut of the gas as much as possible exists between an inner peripheral edge portion of the partition wall 109 and the rotor cylindrical portion 23. The partition wall 109 does not rotate by functions as a fixed disc that remains stationary, and guides the gas to the cooling trap portion 81. In this manner, the rotor cylindrical portion 23 can be processed easily. As the cooling trap portion 81, the one same as that of the second embodiment is employed.

Figure 6:
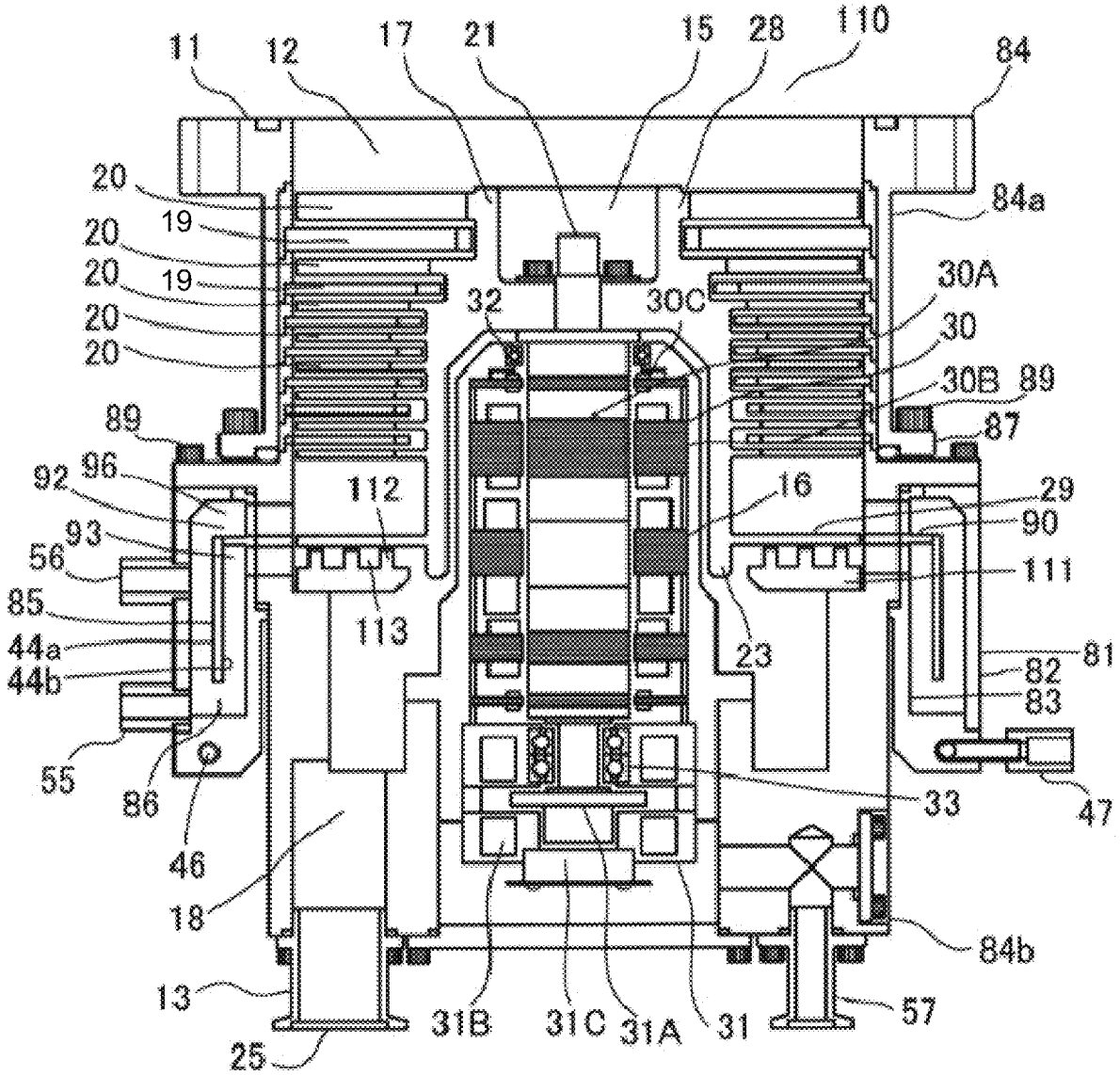
FIG. 6 is a vertical cross-sectional view of a turbomolecular pump according to a fourth embodiment of the present invention.

FIG. 6 shows a turbomolecular pump 110 according to a fourth embodiment of the present invention. In the turbomolecular pump 110 of the fourth embodiment, the partition wall 29 is integrally processed on the rotor cylindrical portion 23, as with the second embodiment (FIG. 4, FIG. 2B). Moreover, in the fourth embodiment, the rotor cylindrical portion 23 is formed shorter in the axial direction than that of the second embodiment.

In the fourth embodiment, in place of the thread stator 24 of the second embodiment, a disc-shaped thread stator 111 (a type called "Siegbahn," "Jigbahn," or "Jiegbahn") is employed. A plurality of spiral wall portions 112 and a plurality of thread groove portions 113 divided by the spiral wall portions 112 are formed in the thread stator 111 in the circumferential direction.

In FIG. 6, the thread stator 111 is fixed to the outlet-side casing 84*b*. The thread stator 111 is disposed below the partition wall 29, and the spiral wall portions 112 and the thread groove portions 113 are caused to face the partition wall 29 (upper side in FIG. 6). The thread stator ill faces the trap outflow port 93 of the cooling trap portion 81 while having an outer peripheral end thereof close to the trap outflow port 93 (at substantially the same height, in FIG. 1).

The thread stator 111 takes the cooled gas that has flowed out from the trap outflow port 93, into the thread groove portions 113 and guides said gas in the centripetal direction (toward the rotation center) while compressing said gas between the thread stator 111 and the rotating partition wall 29. An outlet of the thread groove portions 113 (thread groove outlet) is located in an inner peripheral portion of the thread stator 111, and the gas compressed by a thread groove pump mechanism portion 114 is led out to the side of the rotor cylindrical portion 23. Here, a typical thread stator known as Siegbahn (or Jiegbahn) can be employed as the thread stator 111.

According to the turbomolecular pump 110 of the fourth embodiment, the heights of the thread stator 111 and the trap outflow port 93 can easily be matched, and an inlet of the thread groove portions 113 (thread groove inlet) and the trap outflow port 93 can be brought close to each other. Also, the outflow direction of the gas from the trap outflow port 93 and the direction in which the gas is compressed by the thread stator 111. (transfer direction) can be matched as well (both directions can be the centripetal direction). Therefore, the gas can be smoothly supplied from the trap outflow port 93 to the thread stator 111 with a small exhaust resistance without changing the direction.

Figure 7:
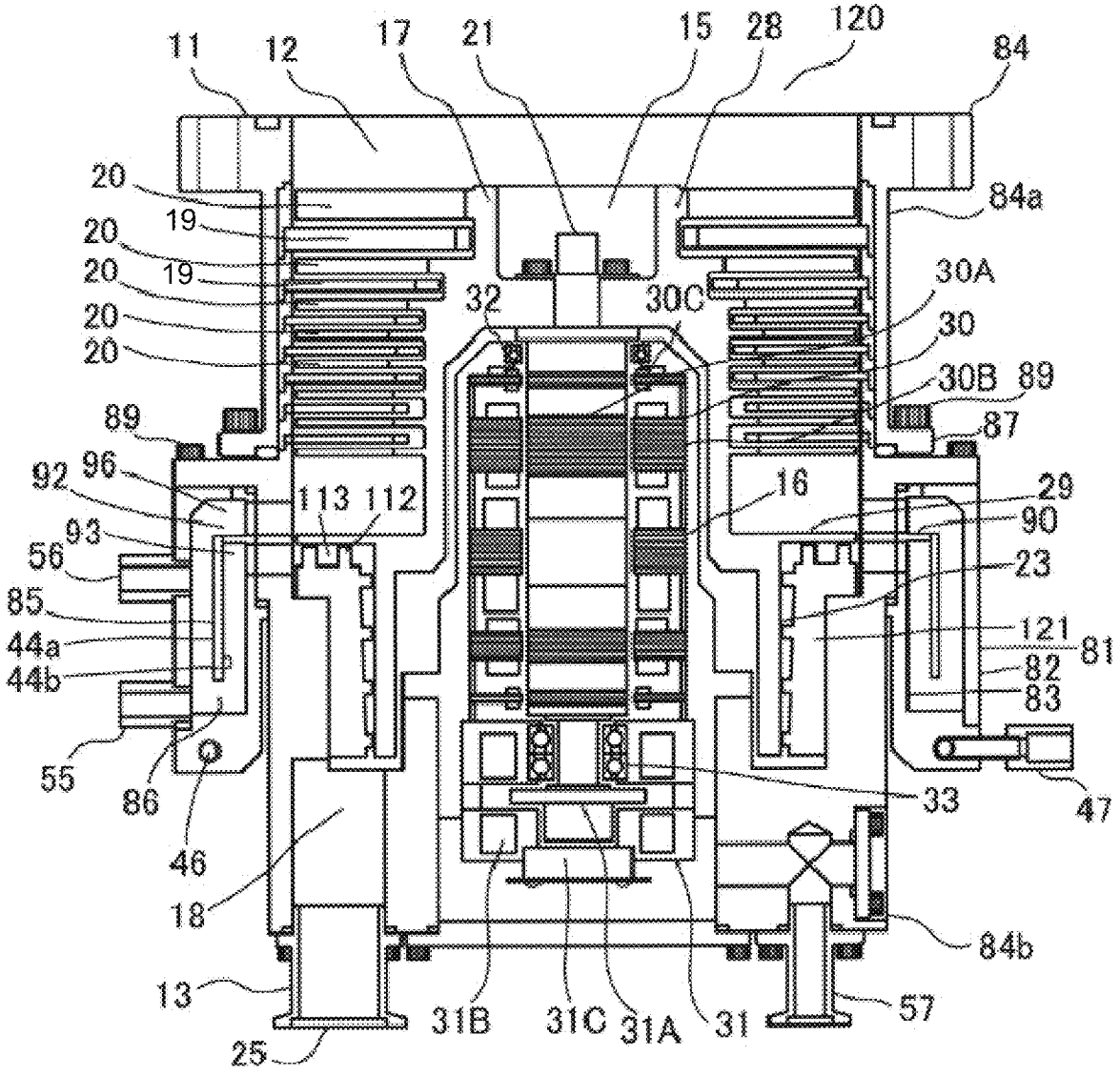
FIG. 7 is a vertical cross-sectional view of a turbomolecular pump according to a fifth embodiment of the present invention.

FIG. 7 shows a turbomolecular pump 120 according to a fifth embodiment of the present invention. The configurations of parts the turbomolecular pump 120 of the fifth embodiment other than a thread stator 121 are the same as those illustrated in the second embodiment (FIG. 4, FIG. 2B). The thread stator 121 is of a type having both a Holbek structure in which the spiral wall portions 26 and the thread groove portions 27 are formed in the axial direction and a Siegbahn structure in which spiral wall portions 112 and thread groove portions 113 are formed in the radial direction.

The thread stator 121 takes the gas that has flowed out from the trap outflow port 93 of the cooling trap portion 81, into the thread groove portions 113 facing the partition wall 29, and transfers said gas while compressing said gas in the centripetal direction. The thread stator 121 also takes the gas that has reached the inner peripheral portion, into the thread groove portions 113 facing the rotor cylindrical portion 23, and transfers said gas while compressing said gas downward in the axial direction in FIG. 7.

By providing this type of thread stator 121, the gas flowing out from the trap outflow port 93 can smoothly be taken into the thread groove portions 113, and can be compressed in multiple stages (in this case, two stages: in the centripetal direction and axially downward).

Figure 8:
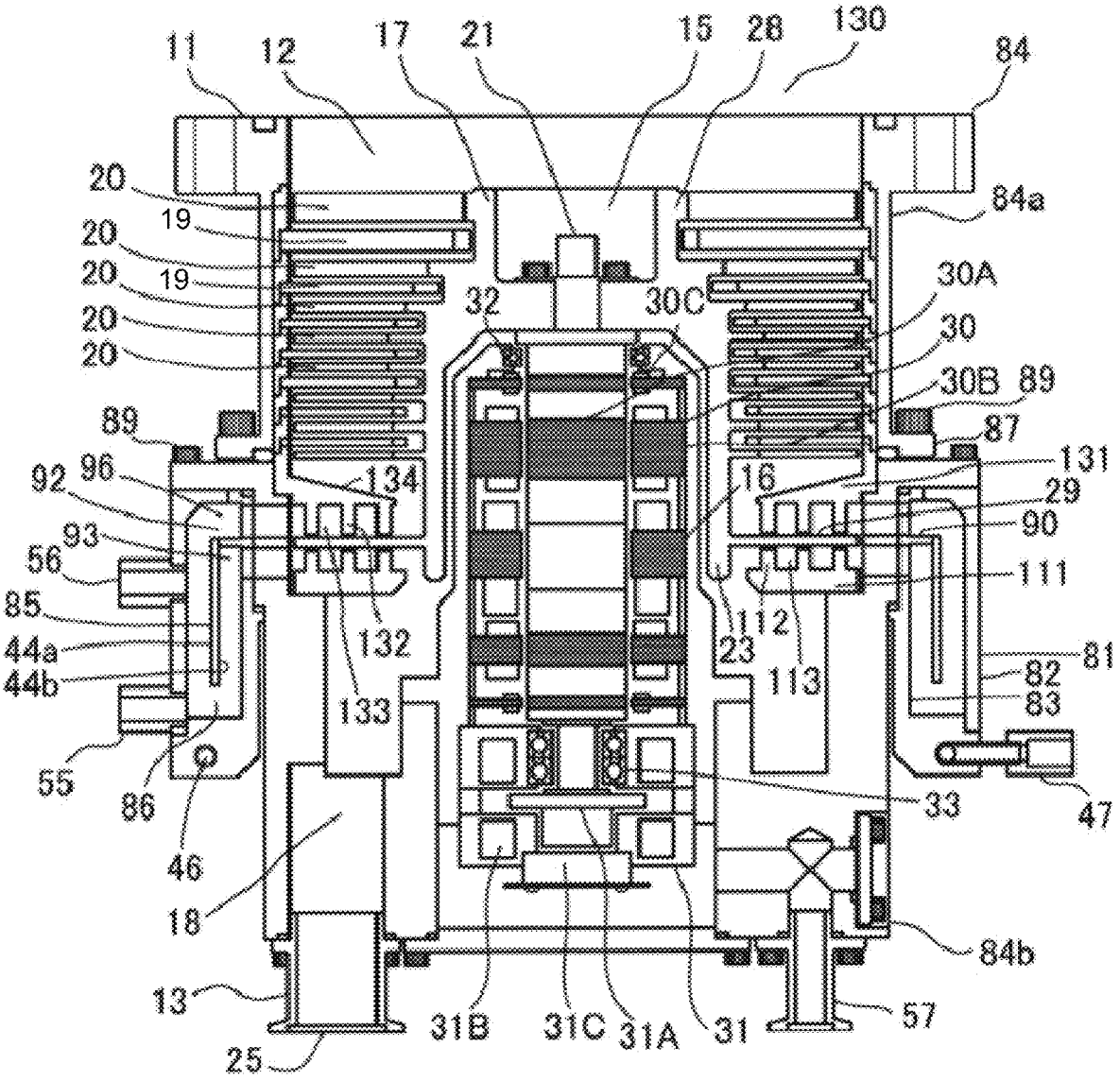
FIG. 8 is a vertical cross-sectional view of a turbomolecular pump according to a sixth embodiment of the present invention.

FIG. 8 shows a turbomolecular pump 130 according to a sixth embodiment of the present invention. The turbomolecular pump 130 of the sixth embodiment is provided with a thread stator 111 (Siegbahn) same as that of the turbomolecular pump 110 according to the fourth embodiment (FIG. 6), and another thread stator 131 above the partition wall 29. Hereinafter, the thread stator same as that of the fourth embodiment is referred to as a first thread stator 111, and the other thread stator is referred to as a second thread stator 131, to distinguish between these two thread stators.

The second thread stator 131 is a Siegbahn type as with the first thread stator 111, and has a plurality of spiral wall portions 132 and thread groove portions 133 formed in the circumferential direction, the thread groove portions 133 being divided by the spiral wall portions 132. In FIG. 8, the second thread stator 131 is disposed above the partition wall 29, wherein the spiral wall portions 132 and the thread groove portions 133 are fixed to the inlet-side casing 84*a* while facing the partition wall 29 (lower side in FIG. 8). The second thread stator 131 also faces the trap inflow port 92 of the cooling trap portion 81 while having an outer peripheral end thereof close to the trap inflow port 92.

The second thread stator 131 has a guiding portion 134 that is inclined so that the gas led out from the outlet of the turbomolecular pump mechanism portion 17 (turbine outlet) can be guided toward the rotation center side and the partition wall 29 side. Moreover, the second thread stator 131 takes the gas that has been guided by the guiding portion 134, into the thread groove portions 133 at the rotation center side and guides said gas in the centripetal direction while compressing said gas between the second thread stator 131 and the rotating partition wall 29. An outlet of the thread groove portions 133 faces the trap inflow port 92, and the second thread stator 131 further compresses the gas that has been led out from the turbomolecular pump mechanism portion 17, and sends the compressed gas to the cooling trap portion 81.

According to the turbomolecular pump 130 of the sixth embodiment, not only the compression of the gas by the first thread stator 111 but also the compression of the gas by the second thread stator 131 can be performed by rotating the one partition wall 29. The gas led out from the turbomolecular pump mechanism portion 17 can be smoothly sent to the trap inflow port 92 and compressed in multiple stages (two stages, in this case).

Figure 9:
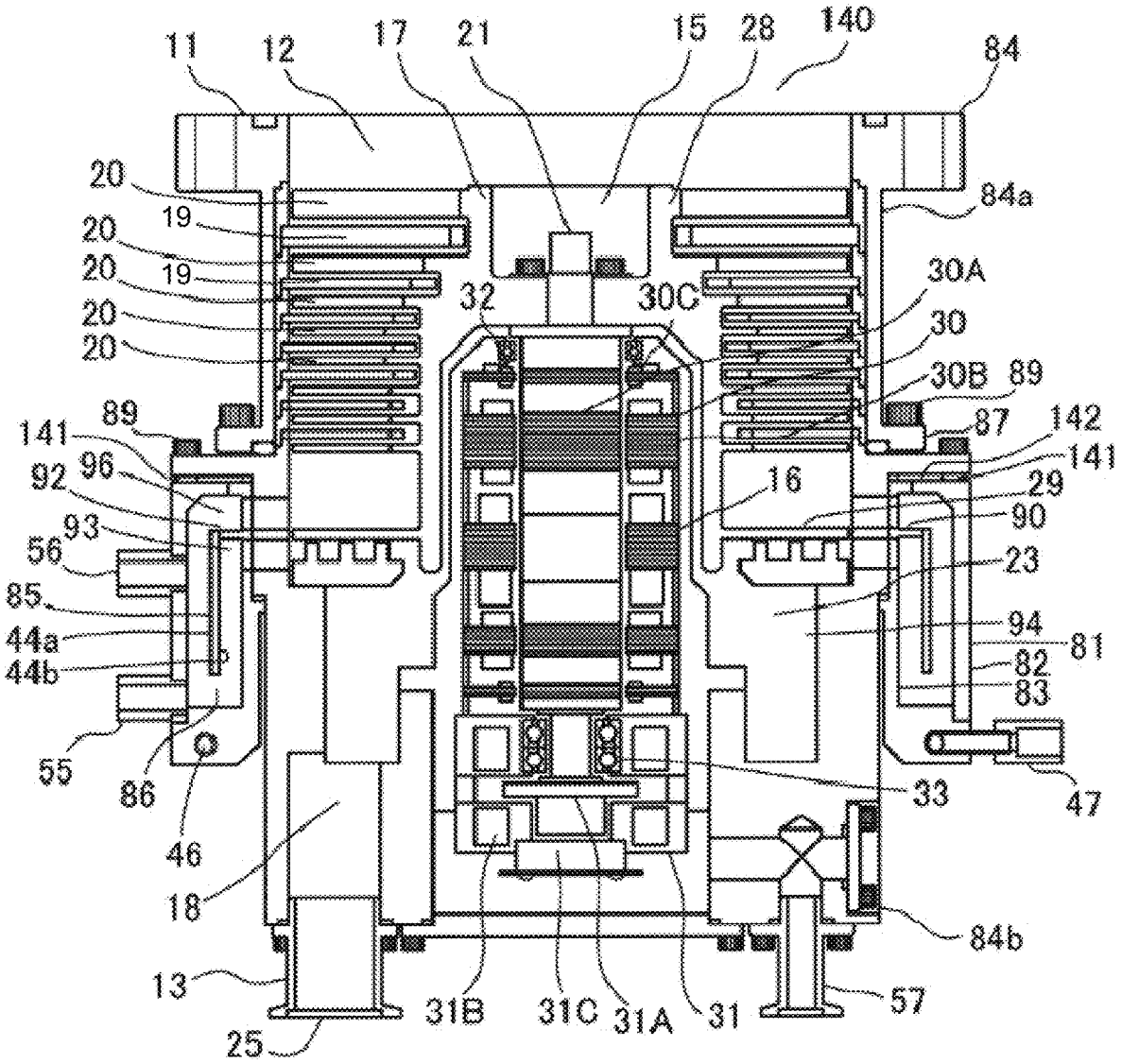
FIG. 9 is a vertical cross-sectional view of a turbomolecular pump according to a seventh embodiment of the present invention.

FIG. 9 shows a turbomolecular pump 140 according to a seventh embodiment of the present invention. In the turbomolecular pump 140 of the seventh embodiment, the same configuration as that of the turbomolecular pump 110 according to the fourth embodiment is adopted, and a plurality of heat insulating rings 141 constituting a heat insulating structure in an attachment portion of the cooling trap portion 81 are sandwiched between the cooling trap portion 81 and the flange portion 87 of the inlet-side casing 84*a*.

Stainless steel washers, for example, can be used as the heat insulating rings 141, and bolt shafts of the hex socket screws 89 for fixing the cooling trap portion 81 are inserted into the respective heat insulating rings 141. The heat insulating rings 141 form a space portion 142 functioning as an air layer, between the cooling trap portion 81 and the flange portion 87.

According to the turbomolecular pump 140 of the seventh embodiment, heat insulation by the space portion 142 can be performed between an upper surface of the cooling trap portion 81 and the flange portion 87 of the inlet-side casing 84*a*. Therefore, the contact area between the cooling trap portion 81 and the inlet-side casing 84*a* can be prevented from becoming excessively large. Also, the temperature at the outlet of the turbomolecular pump mechanism portion 17 (turbine outlet) can be kept at an appropriate level. In addition, deposits can be generated intensively in the cooling trap portion 81, and precipitation of deposits in parts other than the cooling trap portion 81 (such as the turbomolecular pump mechanism portion 17) can be prevented.

Further, the gap 88 between the cooling trap portion 81 and the outlet-side casing 84*b* described above (here, FIG. 2B is incorporated since the gap 88 is the same as that of the second embodiment) and the space portion 142 described above can be combined to perform heat insulation, and the temperatures of the cooling trap portion 81 and the peripheral portions thereof can easily be kept at appropriate levels. Furthermore, since stainless steel, which has lower thermal conductivity than aluminum, is employed as the material of the heat insulating rings 141 the heat insulating property between the inlet-side casing 84*a* and the cooling trap portion 81 holding the heat insulating rings 141 therebetween can be enhanced ley the heat insulating rings 141 themselves.

Figure 10:
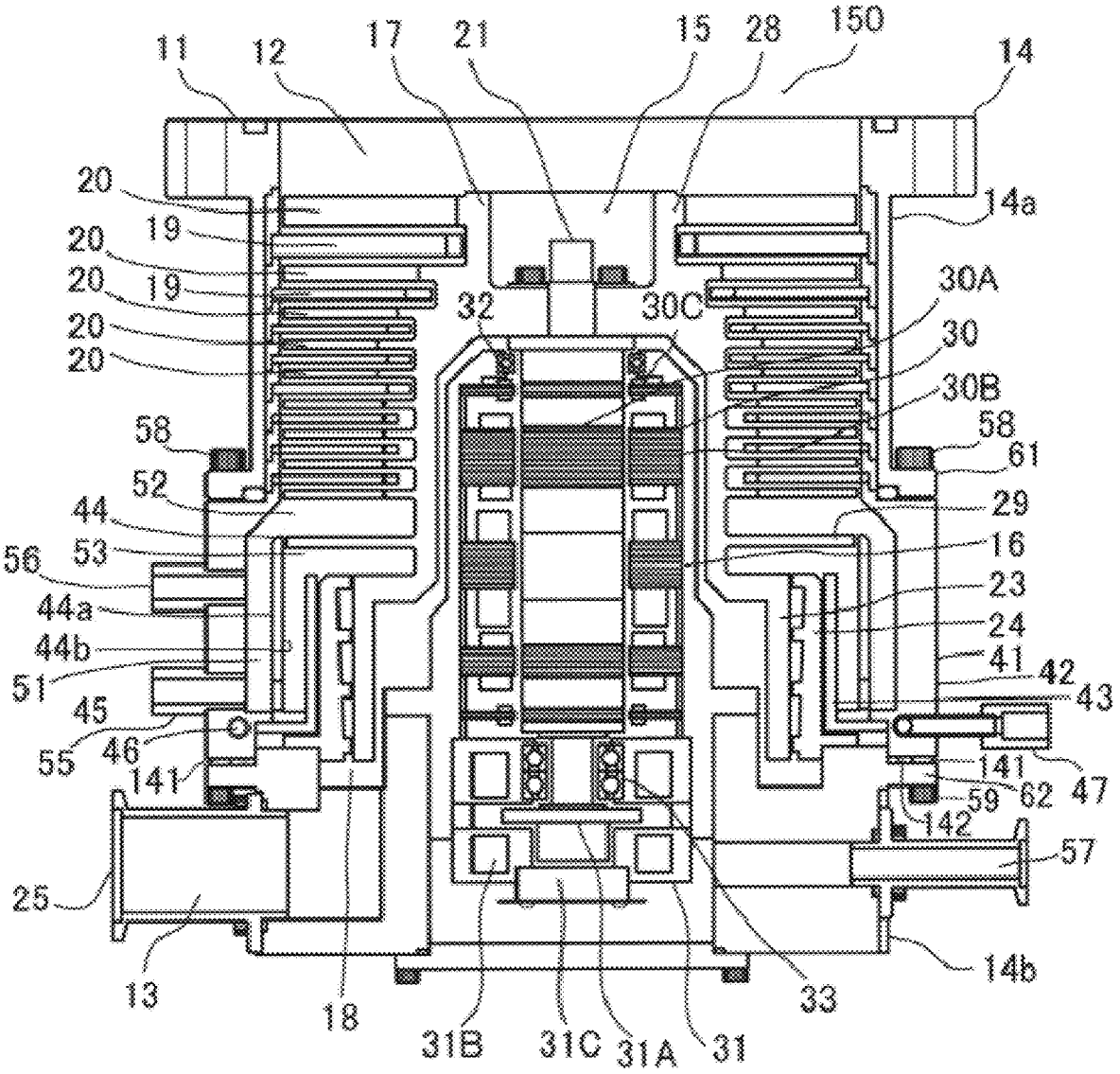
FIG. 10 is a vertical cross-sectional view of a turbomolecular pump according to an eighth embodiment of the present invention.

FIG. 10 shows a turbomolecular pump 150 according to an eighth embodiment of the present invention. In the turbomolecular pump 150 of the eighth embodiment, the same configuration as that of the turbomolecular pump 10 according to the first embodiment (FIG. 1, FIG. 2A) is adopted, and the plurality of heat insulating rings 141 are sandwiched between the cooling trap portion 41 and the flange portion 62 of the outlet-side casing 14*b*.

As with the heat insulating rings 141 of the seventh embodiment, stainless steel washers, for example, can be used as the heat insulating rings 141. Bolt shafts of the hex socket screws 59 for fixing the cooling trap portion 41 are inserted into the respective heat insulating rings 141. The heat insulating rings 141 form the space portion 142 functioning as an air layer, between the cooling trap portion 41 and the flange portion 62.

According to the turbomolecular pump 150 of the eighth embodiment, heat insulation by the space portion 142 can be performed between a lower surface of the outer body portion 42 of the cooling trap portion 41 and the flange portion 62 of the outlet-side casing 14*b*. Therefore, the contact area between the cooling trap portion 41 and the outlet-side casing 14*b* can be prevented from becoming excessively large. Consequently, the temperature, of the thread groove pump mechanism portion 18 can be kept favorably. In addition, precipitation of deposits in the thread groove pump mechanism portion 18 and insufficient cooling of the gas in the cooling trap portion 81 can be prevented.

Although not shown, the heat insulating rings can be sandwiched between an upper surface of the outer body portion 42 of the cooling trap portion 41 and the flange portion 61 of the inlet-side casing 14*a*, to perform the heat insulation by the space portion formed by the heat insulating rings. Further, combining these heat insulation methods, heat insulation can be performed above and below the outer body portion 42 of the cooling trap portion 41.

As for cooling methods, water-cooling (e.g., the first to eighth embodiments), installing a refrigerator, and Peltier cooling (use of a Peltier element) can be considered. Also, in order to secure a surface area, installing fins (cooling plates) the cooling trap portion (e.g., the first to eighth embodiments) can be considered.

Next, regarding the function of removing deposits, washing the deposits off with water (e.g., the first to eighth embodiments), sifting off the deposits, physically scraping the deposits, and replacing the whole cooling trap portion (e.g., the first to the eighth embodiments) can be considered. Of these methods, washing the deposits off with water may be performed with application of ultrasonic waves (vibrations). Further, washing the deposits off with water may involve installing a cleaning fluid inlet/outlet and pointing the cleaning fluid outlet below the outlet of the gas e.g., the first to eighth embodiments).

Sifting off the deposits may involve applying a non-adhesive coating to the place where the sedimentary components can be precipitated and thereby weakening the binding force between the deposits and the part, making it easier to sifting off the deposits by means of vibration or impact. Examples of the non-adhesive coating include coating with a Teflon (registered trademark)-coated film.

Subsequently, regarding the function of reducing a pipe resistance, feeding the gas using the rotating disc (e.g., the embodiments other than the third embodiment.) and connecting the pipe to the Siegbahn inlet (e.g., the fourth to seventh embodiments shown in FIGS. 6 to 9) can be considered.

The embodiments of the present invention and each of the modifications of the present invention may be combined as needed, Note that the present invention is not limited to the foregoing embodiments and modifications and therefore can be modified in various ways without departing from the gist of the present invention.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

What is claimed is:

1. A vacuum pump, comprising:

a casing having an inlet portion and an outlet portion for gas;

a pump mechanism portion in which a stator blade and a rotor blade are formed;

a thread groove exhaust mechanism portion provided at a downstream side of the pump mechanism portion;

a cooling trap portion comprising a flow channel located between an outlet of the pump mechanism portion and the thread groove exhaust mechanism portion, the cooling trap portion cooling the gas in the flow channel, wherein at least a portion of the flow channel located between the outlet of the pump mechanism portion and the thread groove exhaust mechanism portion is defined between an inner surface of a first fixed wall and an outer surface of a second fixed wall wherein at least one of the inner surface and the outer surface is a straight circular cylindrical surface; and a partition wall portion that guides the gas led out from the pump mechanism portion to the cooling trap portion.

2. The vacuum pump according to claim 1, wherein the partition wall portion is a disc-shaped member installed in the casing.

3. The vacuum pump according to claim 2, wherein the partition wall portion is provided integrally with the rotor blades.

4. The vacuum pump according to claim 1, wherein the thread groove exhaust mechanism portion is provided downstream of the partition wall portion.

5. The vacuum pump according to claim 1, wherein a second thread groove exhaust mechanism portion is provided upstream of the partition wall portion.

6. The vacuum pump according to claim 1, wherein the cooling trap portion has a trap temperature falling below a sublimation temperature of at least one gas component.

7. The vacuum pump according to claim 1, wherein the cooling trap portion has an attachment portion configuring a heat insulating structure.

8. The vacuum pump according to claim 1, wherein further comprising a deposit removal function that removes deposits in the cooling trap portion.

9. The vacuum pump according to claim 1, wherein the cooling trap portion is provided with a second inflow and outflow port different from a first inflow and outflow port which is an inflow and outflow port for the gas.

10. The vacuum pump according to claim 1, wherein the cooling trap portion has a non-adhesive coating applied to at least a part of an inner surface of the cooling trap portion.

11. The vacuum pump according to claim 1, wherein the casing is configured by combining the cooling trap portion and a predetermined casing member, of which only the cooling trap portion is detachable.

12. The vacuum pump according to claim 1 wherein a first surface of the partition wall guides gas in a centrifugal direction toward the cooling trap and a second surface of the partition wall guides gas in a centripetal direction.

* * * * *